US008552861B2

(12) United States Patent
Bastide et al.

(10) Patent No.: US 8,552,861 B2
(45) Date of Patent: Oct. 8, 2013

(54) BIODEGRADABLE SMART SENSOR FOR MESH NETWORK APPLICATIONS

(75) Inventors: Paul R. Bastide, Boxford, MA (US); Matthew E. Broomhall, South Burlington, VT (US); Robert E. Loredo, North Miami Beach, FL (US)

(73) Assignee: International Business Machines Corporation, Armonk, NY (US)

( * ) Notice: Subject to any disclaimer, the term of this patent is extended or adjusted under 35 U.S.C. 154(b) by 175 days.

(21) Appl. No.: 13/085,154

(22) Filed: Apr. 12, 2011

(65) Prior Publication Data

US 2012/0262291 A1 Oct. 18, 2012

(51) Int. Cl.
*G08B 21/00* (2006.01)

(52) U.S. Cl.
USPC ..... 340/540; 264/103; 310/327; 335/205; 340/524; 340/539.22; 359/268; 700/299; 702/33; 702/35; 73/587

(58) Field of Classification Search
USPC ..... 340/524, 539.22, 540; 702/33, 35; 359/268; 73/587; 310/327; 335/205; 264/103; 700/299
See application file for complete search history.

(56) References Cited

U.S. PATENT DOCUMENTS

| | | | | |
|---|---|---|---|---|
| 3,417,354 | A * | 12/1968 | Wenner et al. | 335/205 |
| 3,427,481 | A * | 2/1969 | Colbert et al. | 310/327 |
| 5,195,046 | A * | 3/1993 | Gerardi et al. | 702/35 |
| 5,524,491 | A * | 6/1996 | Cavalloni | 73/587 |
| 6,073,493 | A | 6/2000 | Sakamoto et al. | |
| 7,322,244 | B2 | 1/2008 | Kim | |
| 7,668,665 | B2 * | 2/2010 | Kim | 702/33 |
| 8,182,725 | B2 * | 5/2012 | Green et al. | 264/103 |
| 2007/0262863 | A1 * | 11/2007 | Aritsuka et al. | 340/539.22 |
| 2009/0243836 | A1 * | 10/2009 | McSheffrey | 340/524 |
| 2011/0096388 | A1 * | 4/2011 | Agrawal et al. | 359/268 |
| 2011/0115624 | A1 * | 5/2011 | Tran | 340/540 |
| 2012/0109404 | A1 * | 5/2012 | Pandey et al. | 700/299 |

FOREIGN PATENT DOCUMENTS

EP 1743781 A2 * 1/2007

OTHER PUBLICATIONS

Lee, Chris, "Scientists create paper-thin, flexible, biodegradable battery", Aug. 13, 2007, Conde Nast, p. 1.*

A. de Guardia, C. Petiot, J.C. Benoist, C. Druihe, "Characterization and modeling of the heat transfers in a pilot-scale reactor during composting under forced aeration", Waste Management, vol. 32, Issue 6, Jun. 2012, pp. 1091-1105, ISSN 0956-053X, 10.1016/j.wasman.2011.12.028.*

* cited by examiner

*Primary Examiner* — Daniel Wu
*Assistant Examiner* — Israel Daramola
(74) *Attorney, Agent, or Firm* — Steven M. Greenberg, Esq.; Carey, Rodriguez, Greenberg & O'Keefe

(57) ABSTRACT

Embodiments of the present invention provide a method, system and computer program product for a biodegradable sensor device for mesh networking applications. In an embodiment of the invention, a biodegradable sensor device for mesh networking applications is provided. The device includes a frame formed of biodegradable material such as a mixture of polylactic acid and a resin, a biodegradable battery such as a flexible biodegradable lithium ion battery, an antenna, an environmental event detector formed from biodegradable material responsive to a change in environmental conditions, and signal generating circuitry configured to be responsive to detecting an environmental event by broadcasting a signal to other sensor devices in a mesh network and also to re-broadcast signals received from other sensor devices in the mesh network.

10 Claims, 3 Drawing Sheets

BIODEGRADABLE SMART SENSOR FOR MESH NETWORK APPLICATIONS

BACKGROUND

Present invention to remote sensing and more particularly to mesh network sensing of environmental conditions.

DESCRIPTION OF RELATED ART

Mesh networking refers to a multi-hop communications network in which the nodes of the network act as a router for data from other nodes. Consequently, a mesh network provides for continuous communicative connections between nodes and the ad-hoc reconfiguration of data paths throughout the network in response to broken or blocked paths. Mesh networks differ from other networks in that the component parts all connect to each other via multiple hops, and those component parts, in comparison to mobile ad-hoc networks, generally are not mobile. Of import, mesh networks are self-healing and can operate when one node fails or when a communicative linkage between nodes drops. As a result, mesh networks are known to be very reliable.

Mesh networks find substantial application in the field of remote sensing. Remote sensing refers to the acquisition of information of an object or phenomenon, by the use of either recording or real-time sensing device that is either wireless or not in physical or intimate contact with the object. In practice, remote sensing provides for the standoff collection of data through the use of a variety of devices for gathering information on a given object or area. There are two main types of remote sensing: passive remote sensing and active remote sensing. In passive remote sensing, passive sensors detect natural wave emissions emitted or reflected by the target object or surrounding area. Active remote sensing, by comparison, utilizes active sensors that emit energy in order to scan objects and areas whereupon the sensors then detect and measure the reflected or backscattered radiation from the target.

A wireless sensor network (WSN) is a physical embodiment of a remote sensing system. A WSN primarily includes a selection of spatially distributed autonomous sensors cooperatively monitoring physical or environmental conditions, such as temperature, sound, vibration, pressure, motion or pollutants. In addition to one or more sensors, each node in a WSN is typically equipped with a radio transceiver or other wireless communications device, a microcontroller, and a power source, usually a battery. Of note, a WSN normally constitutes a wireless ad-hoc network, meaning that each sensor supports a multi-hop routing algorithm where nodes function as forwarders, relaying data packets to a base station.

Of import, the deployment of a multitude sensors in a mesh network topology as part of a WSN can result in the substantial waste of material in the form of each deployed sensor. Traditional sensors include housings formed of nylon or include some form of polymeric resin base such as polyethylene. Neither is biodegradable. As a result, while deploying a mesh network of a minimal number of sensors can be of no consequence because each sensor can be retrieved and possibly reused, in a mesh network of hundreds or thousands or even more sensors, the impact to the environment can be substantial. Notwithstanding, it has been recognized that two primary problems to be overcome in order to increase acceptance and use of biodegradable products in sensor applications are strength and price. Polyethylene, unlike its biodegradable lactic acid counterpart, is a low cost resin that is versatile enough to handle the physical requirements of common applications and is less expensive.

BRIEF SUMMARY

Embodiments of the present invention address deficiencies of the art in respect to remote sensing in a mesh network and provide a novel and non-obvious method, system and computer program product for a biodegradable sensor device for mesh networking applications. In an embodiment of the invention, a biodegradable sensor device for mesh networking applications is provided. The device includes a frame formed of biodegradable material such as a mixture of polylactic acid and a resin, a biodegradable battery such as a flexible biodegradable lithium ion battery, an antenna, an environmental event detector formed from biodegradable material responsive to a change in environmental conditions, and signal generating circuitry configured to be responsive to detecting an environmental event by broadcasting a signal to other sensor devices in a mesh network and also to re-broadcast signals received from other sensor devices in the mesh network.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION

Embodiments of the invention provide for a biodegradable sensor device for mesh networking applications. In accordance with an embodiment of the invention, a biodegradable sensor device can include a biodegradable flexible battery, an antenna, an environmental event detector, and signal generating circuitry configured to be responsive to detecting an environmental event. The environmental event detector can be powered by the battery and can be formed by sandwiched layers of biodegradable material reactive to the environmental event and a conductor conducting a signal to the circuitry responsive to the reaction of the reactive material to the environmental event. The circuitry, in turn, can be formed of a biodegradable polymer and resin establishing an arrangement of logic gates powered by the battery providing a signal to the antenna for broadcast onto a mesh network when received from the detector or when received from the antenna from another sensor device in the mesh network. Thus, to the extent that the vast majority of the materials of the sensor will biodegrade within six months, the sensor itself is to be considered biodegradable.

Figure 1:
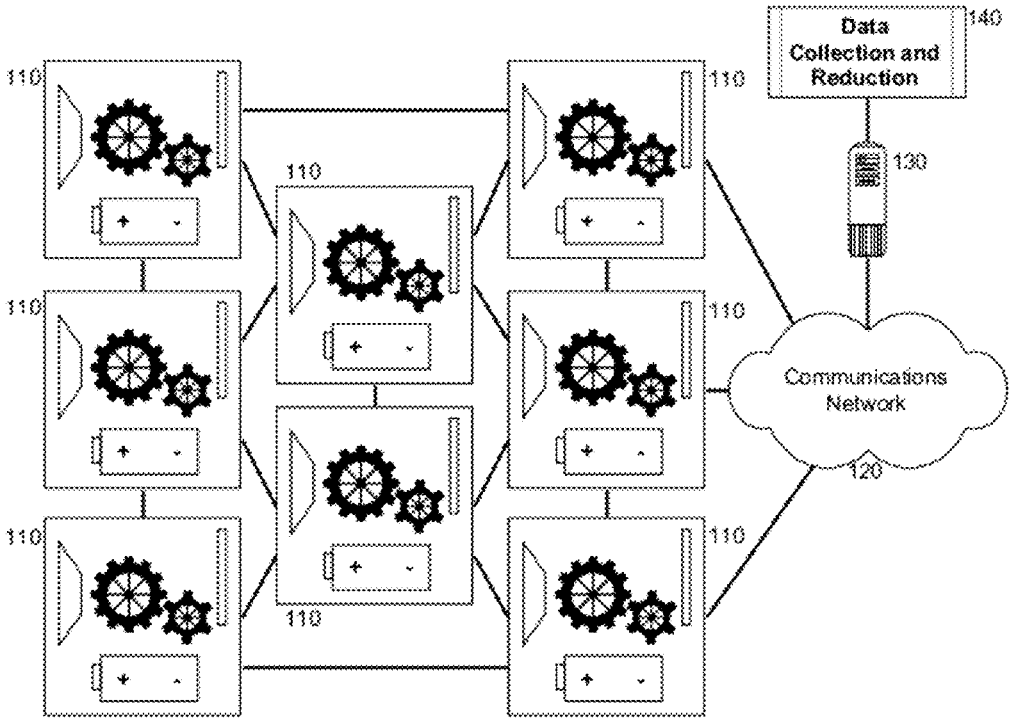
FIG. 1 is a schematic illustration of a mesh network configured for detecting an environmental event using biodegradable sensor devices.

In further illustration, FIG. 1 schematically shows a mesh network configured for detecting an environmental event using biodegradable sensor devices. As shown in FIG. 1, a mesh network of different sensors 110 coupled to one another in a multi-hop communications environment can be provided. Each of the sensors 110 can be biodegradable in nature, formed primarily of biodegradable materials. Further, each of the sensors 110 can be communicatively coupled to others of the sensors 110 in a wireless fashion so that data transmitted from one of the sensors 110 can be received by proximately disposed coupled ones of the other sensors 110 and relayed through re-broadcasting on to data collection and reduction logic 140 executing in memory of a host server over a computer communications network 120.

Figure 2:
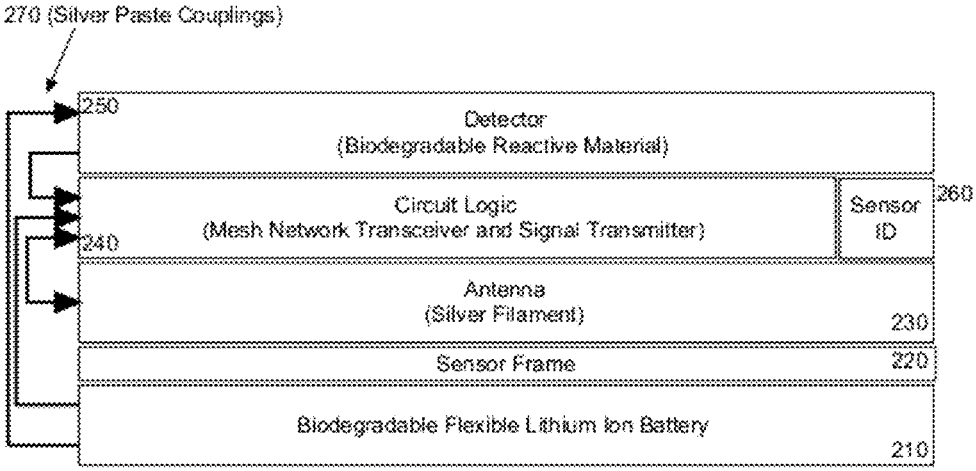
FIG. 2 is a block diagram of a biodegradable sensor device for mesh networking applications.

As noted, each of the sensors 110 can be biodegradable in nature. In more specific illustration, FIG. 2 is a block diagram of a biodegradable sensor device for mesh networking applications. The sensor of FIG. 2 can include a sensor frame 220 formed of a biodegradable material such as a moldable biodegradable polymer. An exemplary biodegradable polymer can include a biodegradable polymer formed of a mix of polylactic acid and resin as is well-known in the art. The sensor frame 220 can support a biodegradable flexibly shapeable battery 210, such as a biodegradable flexible lithium ion battery. The sensor frame 220 also can support an antenna 230 which can be formed on a surface of the sensor frame 220 from a silver filament.

Circuit logic 240 can be coupled each to the antenna 230 and also an event detector 250, and powered by the battery 210. The circuit logic 240 can be a multi-layer laminate of alternating layers of the biodegradable polymer and a silver paste to create a sequence of logic gates. Multiple different arrangements of logic gates can be formed in the circuit logic 240 to provide a simple boolean switch activatable by an electrical signal received from the event detector 250 over silver paste couplings 270. The logic gates of the circuit logic 240 also can be arranged to repeat a signal received from the antenna 230, and to provide a periodic keep alive signal. The logic gates of the circuit logic 240 further can be arranged to provide a counter indicating a number of times a signal has been received from the event detector 250. Finally, the logic gates of the circuit logic 240 can be arranged to store a fixed value as a unique identifier of the sensor for trans-mission along with any data provided by the circuit logic 240 in order to identify to a collector the source of collected data.

Of note, the event detector 250 can be formed of a biodegradable reactive material reactive to a particular environmental condition such as a change in temperature, pressure, moisture, or frequency of vibration. Other changes in environmental conditions detectable by the biodegradable reactive material include a chemical dissolution of the material in the presence of a particular chemical or biologic agent. The reactive quality of the material can include a volumetric expansion or contraction of the material, or the dissolution of the material. In even yet further illustration of the nature of the event detector 250, FIGS. 3A and 3B, taken together, are a pictorial illustration of a biodegradable event detector for use in the biodegradable sensor device of FIG. 2.

Figure 3A:
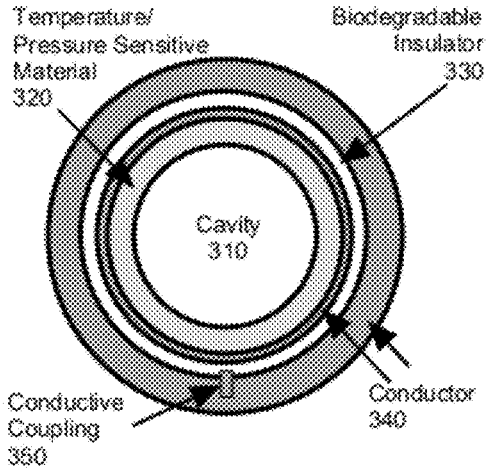
FIGS. 3A and 3B, taken together, are a pictorial illustration of a biodegradable event detector for use in the biodegradable sensor device of FIG. 2.

Considering first FIG. 3A, an event detector can be tubular in shape enclosing a cavity 310. A temperature or pressure sensitive biodegradable material 320 can define the cavity 310 and can be concentrically placed in communication with a conductive material 340 concentrically bifurcated by a biodegradable insulator 330. A conductive coupling 350 can be placed at normal within one concentric layer of the conductor 340 and into the biodegradable insulator 330, but not to the extent that the conductive coupling 350 contacts the other concentric layer of the conductor 340 in the absence of a reaction of the temperature or pressure sensitive biodegradable material 320.

However, the conductive coupling 350 can be arranged to contact the other concentric layer of the conductor 340 in response to an expansion of the temperature or pressure sensitive biodegradable material 320 compressing the inner concentric layer of the conductor 340 towards the outer concentric layer of the conductor 340. To the extent that each the concentric layers of the conductor 340 form a closed circuit when coupled by the conductive coupling 350, but an open circuit when not coupled by the conductive coupling 350, the event detector of FIG. 3A can generate an electrical signal in response to the reaction of the temperature or pressure sensitive biodegradable material 320.

Figure 3B:
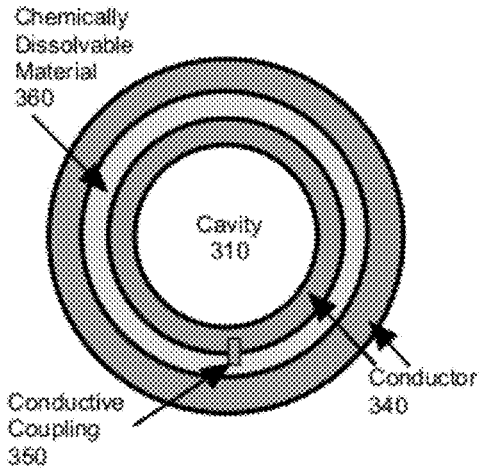

Turning now to FIG. 3B, an event detector once again can be tubular in shape enclosing a cavity 310. A conductive material 340 concentrically bifurcated by a chemically dissolvable biodegradable material 360 can define the cavity 310. A conductive coupling 350 can be placed at normal within one concentric layer of the conductor 340 and into the chemically dissolvable biodegradable material 360, but not to the extent that the conductive coupling 350 contacts the other concentric layer of the conductor 340 in the absence of a reaction of the chemically dissolvable biodegradable material 360. However, the conductive coupling 350 can be arranged to contact the other concentric layer of the conductor 340 in response to a dissolution of the chemically dissolvable biodegradable material 360 responsive the chemically dissolvable biodegradable material 360 dissolving in the presence of a particular chemical, whether the chemical is in the form of a liquid or gas. To the extent that each of the concentric layers of the conductor 340 form a closed circuit when coupled by the conductive coupling 350, but an open circuit when not coupled by the conductive coupling 350, the event detector of FIG. 3B can generate an electrical signal in response to the reaction of the chemically dissolvable biodegradable material 360.

Figure 4:
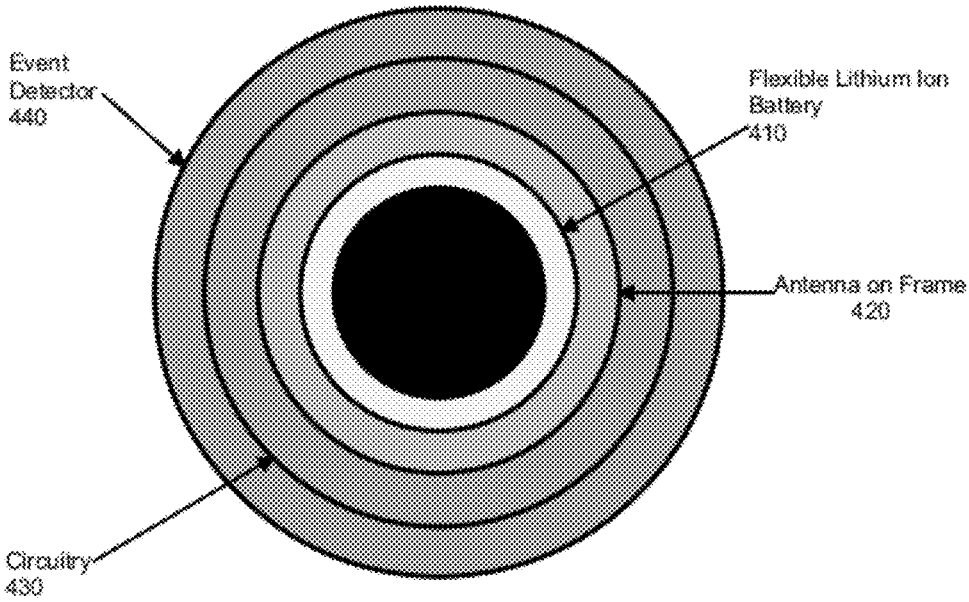
FIG. 4 is a cross-sectional diagram of an embodiment of the biodegradable sensor device of FIG. 2.

By incorporating the event detector of FIGS. 3A and 3B into the biodegradable sensor, a mesh network of substantial numbers of nodes can be provided without the adverse environmental impact expected of a traditional remote sensing mesh network. In even yet further illustration, FIG. 4 is a cross-sectional diagram of the biodegradable sensor device of FIG. 2 for disposition in a mesh network. As shown in FIG. 4, the sensor can be tubular in nature and can include a flexible lithium ion battery 410 disposed about an inner surface of a tubular frame formed of a polylactic acid and resin mix. The battery 410 can power both circuitry 430 and event detector 440 through silver couplings (not shown). The tubular frame can support the formation on an outer surface of the tubular frame of a coiled antenna 420 with an antenna coil formed of silver filament. The antenna 420 can be linked to circuitry 430 formed of a multi-laminate arrangement of polylactic acid and resin mix in some layers and silver paste in other layers. An event detector 440 can be layered on an outer surface of the circuitry 430 and can be configured to generate an electrical signal for processing in the circuitry 430 and broadcasting by way of the antenna 420. Yet further, the circuitry 430 can be configured to re-broadcast data received from other sensors in the mesh network.

Figure 5:
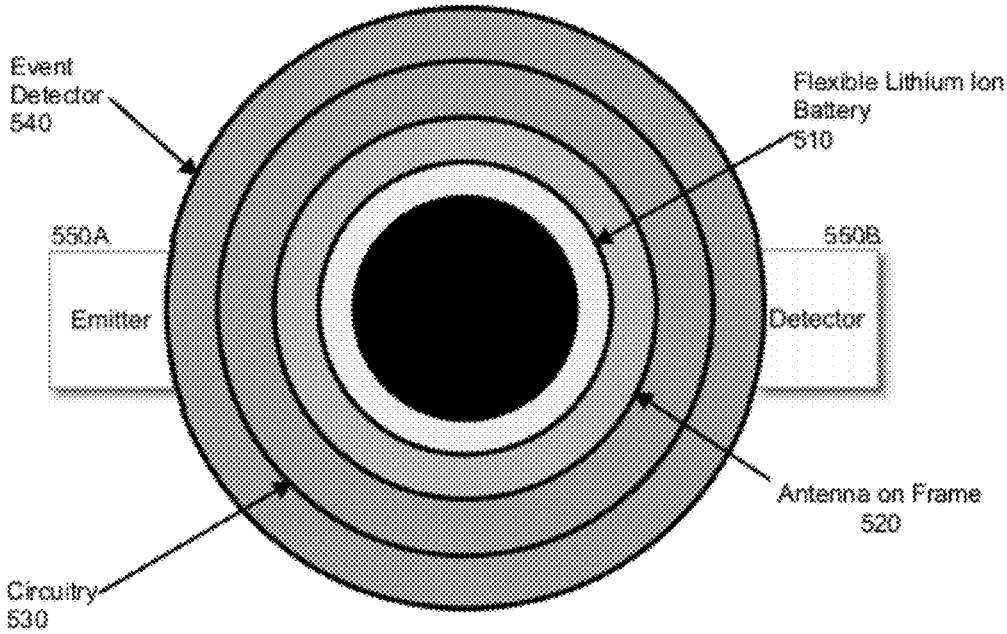
FIG. 5 is a cross-sectional diagram of another embodiment of the biodegradable sensor device of FIG. 2; and, FIG. 6 is a flow chart illustrating a process for detecting material strength through a mesh network of biodegradable sensor devices as shown in FIG. 5.

The mesh network of biodegradable sensor devices described in connection with FIG. 2 can find application in monitoring the integrity of a material forming a structure, such as a concrete structure or form. In illustration, FIG. 5 is a cross-sectional diagram of another embodiment of the biodegradable sensor device of FIG. 2. As shown in FIG. 5, the biodegradable sensor device can be tubular in nature and can include a flexible lithium ion battery 510 disposed about an inner surface of a tubular frame formed of a polylactic acid and resin mix. The battery 510 can power both circuitry 530 and event detector 540 through silver couplings (not shown). The tubular frame can support the formation on an outer surface of the tubular frame of a coiled antenna 520 with an antenna coil formed of silver filament. The antenna 520 can be linked to circuitry 530 formed of a multi-laminate arrangement of polylactic acid and resin mix in some layers and silver paste in other layers.

An event detector 540 can be layered on an outer surface of the circuitry 530 and can be configured to generate a sonic signal through emitter 550 which can be a speaker at a particular frequency. The event detector 540 further can be configured to detect sonic energy through detector 550B such as a microphone. Circuitry 530 can determine a frequency of the detected signal and compared to a known acceptable frequency, or that of the emitted sonic signal. When a threshold variation is detected, indicating an inconsistency in the material through which the sonic signal emanates, circuitry 530 can broadcast an alert to other sensor devices in the mesh network by way of the antenna 520. Yet further, the circuitry 530 can be configured to re-broadcast data received from other sensor devices in the mesh network.

Figure 6:
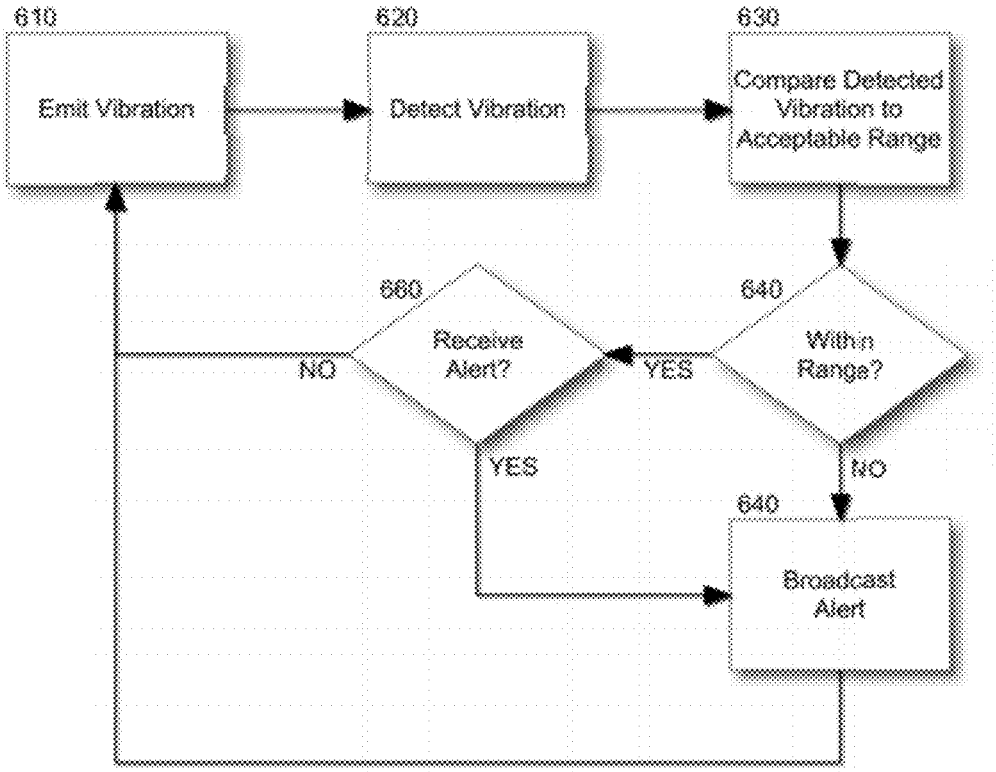

In yet further illustration, FIG. 6 is a flow chart illustrating a process for detecting material strength through a mesh network of biodegradable sensor devices as shown in FIG. 5. Beginning in block 610, a signal resulting in a vibration—for instance a sonic signal—can be emitted from the speaker of a sensor device. In block 620, concurrently a vibration can be detected in the sensor device, for instance by receiving a sonic signal at a microphone of the sensor device. In block 630, the frequency of the detected vibration can be compared to an acceptable range consistent with the integrity of the material. In decision block 640, if it is determined that the frequency of the detected vibration is not in range, in block 640 an alert can be broadcast for transmission through the mesh network of sensor devices. Otherwise, in decision block 660 if an alert is received from another sensor device in the mesh network, in block 640 the alert can be re-broadcast through the mesh network of sensor devices.

The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

We claim:

1. A biodegradable sensor device for mesh networking applications, the device comprising:

a frame formed of biodegradable material;

a biodegradable battery;

an antenna;

an environmental event detector comprising biodegradable material responsive to a change in environmental conditions, and, signal generating circuitry configured to be responsive to detecting an environmental event by broadcasting a signal to other sensor devices in a mesh network and also to re-broadcast signals received from other sensor devices in the mesh network;

wherein the environmental event detector comprises:

bifurcated concentric tubular structures separated by a chemically dissolvable biodegradable material; or bifurcated concentric tubular structures separated by a biodegradable insulator and a temperature reactive biodegradable material coupled to an interior surface of an interior one of the bifurcated concentric tubular structures.

2. The device of claim 1, wherein the biodegradable battery is affixed to one surface of the frame and the antenna is formed on an opposite surface of the frame.

3. The device of claim 1, wherein the frame is formed of a polylactic acid and resin mixture.

4. The device of claim 1, wherein the biodegradable battery is a flexible biodegradable lithium ion battery.

5. The device of claim 1, wherein the device is formed into a tubular structure of concentric tubular structures wherein the battery is formed to be a tubular structure affixed to an interior surface of the frame formed to be a tubular structure and the antenna is formed on an outer surface of the frame and the signal generating circuitry is formed on an outer surface of the antenna and the environmental event detector is formed on an outer surface of the signal generating circuitry.

6. The device of claim 1, wherein the antenna is formed of silver filament.

7. The device of claim 1, wherein environmental event detector further comprises an emitter configured to emit a sonic signal, and a detector configured to detect a sonic signal.

8. A system for monitoring material integrity in a mesh network of biodegradable sensor devices, the system comprising:

a plurality of biodegradable sensor devices embedded in a material, each biodegradable sensor device comprising a frame formed of biodegradable material, a biodegradable battery, an antenna, an environmental event detector comprising biodegradable material responsive to a change in environmental conditions, and, signal generating circuitry configured to be responsive to detecting an environmental event by broadcasting a signal to other sensor devices in a mesh network and also to re-broadcast signals received from other sensor devices in the mesh network; and data collection and reduction logic executing in memory of a host server for colleting data from the biodegradable sensor devices;

wherein the system is configured to emit from the environmental event detector of each of the sensor devices in the material, a sonic signal at a specified frequency;

detect a sonic signal in the environmental event detector of at least one of the sensor devices in the material;

determine a frequency of the detected sonic signal; and, broadcast an alert to others of the sensor devices in the mesh network in response to the determined frequency residing outside of an acceptable frequency range indicative of the integrity of the material.

9. A method for monitoring material integrity in a mesh network of biodegradable sensor devices, the method comprising:

embedding a plurality of biodegradable sensor devices in a material, each of the biodegradable sensor devices comprising a frame formed of biodegradable material, a biodegradable battery, an antenna, an environmental event detector comprising biodegradable material responsive to a change in environmental conditions, and signal generating circuitry configured to be responsive to detecting an environmental event by broadcasting a signal to other sensor devices in a mesh network and also to re-broadcast signals received from other sensor devices in the mesh network;

emitting from the environmental event detector of each of the sensor devices in the material, a sonic signal at a specified frequency;

detecting a sonic signal in the environmental event detector of at least one of the sensor devices in the material;

determining a frequency of the detected sonic signal; and, broadcasting an alert to others of the sensor devices in the mesh network in response to the determined frequency residing outside of an acceptable frequency range indicative of the integrity of the material.

10. The method of claim 9, wherein the material is concrete.

* * * * *